US012295462B2

(12) United States Patent
Ben-Arie

(10) Patent No.: US 12,295,462 B2
(45) Date of Patent: May 13, 2025

(54) BELT RATCHETING DEVICE WITH HIDDEN BLADE IV

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 18/388,542

(22) Filed: Nov. 10, 2023

(65) Prior Publication Data

US 2024/0138531 A1 May 2, 2024

Related U.S. Application Data

(63) Continuation-in-part of application No. 17/976,905, filed on Oct. 31, 2022, now Pat. No. 11,839,268.

(51) Int. Cl.

| | |
|---|---|
| ***A44B 11/12*** | (2006.01) |
| ***A43C 11/14*** | (2006.01) |
| ***A44B 11/00*** | (2006.01) |
| ***A44B 11/16*** | (2006.01) |

(52) U.S. Cl.

CPC ..... *A44B 11/125* (2013.01); *A43C 11/148* (2013.01); *A44B 11/006* (2013.01); *A44B 11/16* (2013.01)

(58) Field of Classification Search

CPC ..... A44B 11/125; A44B 11/006; A44B 11/16; A43C 11/148; A43D 999/00

See application file for complete search history.

(56) References Cited

U.S. PATENT DOCUMENTS

| | | | | |
|---|---|---|---|---|
| 3,592,028 | A * | 7/1971 | La Monica | A44B 11/12 70/57 |
| 3,872,554 | A * | 3/1975 | Wolfertz | A41F 1/008 24/1 |
| 9,215,911 | B1 * | 12/2015 | Carnley | A44B 11/005 |
| 2013/0008056 | A1 * | 1/2013 | Vincent | A43C 11/146 36/114 |
| 2019/0200710 | A1 * | 7/2019 | Ben-Arie | A43C 7/08 |
| 2020/0281327 | A1 * | 9/2020 | Ben-Arie | A44B 11/12 |
| 2021/0251347 | A1 * | 8/2021 | Ben-Arie | A44B 11/16 |

* cited by examiner

*Primary Examiner* — David M Upchurch

(57) ABSTRACT

The Belt Ratcheting Device with Hidden Blade-IV (HB-IV) facilitates unidirectional belt fastening and fast release. The HB-IV includes a turning gate rotatably installed diagonally in a channel. The turning gate has been installed with a hidden blade which controls the belt's translation by engaging the lower belt surface to avoid visible scratches. The turning gate is connected to a lever. The HB-IV has two states: "active" and "inactive". In the active state the device works as a belt ratchet by allowing the belt to be pulled forwards while restricting any belt motion backwards. In the inactive state the belt's motion is facilitated in both directions. The HB-IV states are manually controlled by the lever. After fastening, the belt remains fastened until released. The HB-IV can be adapted to any kind of smooth leather, cloth or synthetic belts. The blade's hidden position and smooth channel's surfaces minimize belt's wear and scratches.

11 Claims, 3 Drawing Sheets

BELT RATCHETING DEVICE WITH HIDDEN BLADE IV

CROSS-REFERENCE TO RELATED APPLICATIONS

This application is Continuation In Part of application Ser. No. 17/976,905 Filed on Oct. 31, 2022.

FEDERALLY SPONSORED RESEARCH

Not Applicable

SEQUENCE LISTING OR PROGRAM

Not Applicable

FIELD OF THE INVENTION

The invention is related to ratcheting devices for fastening belts, bands, straps, ribbons, doth belts, suspenders, sandals, brassieres, watch bands, garment belts strips, laces chords, ropes, strings and alike.

BACKGROUND OF THE INVENTION—PRIOR ART

Several inventions were concerned with ratchet mechanisms configured for fastening waist belts. In U.S. Pat. No. 5,588,186A Soon-Myung Ko filed in 1995 May 26 a patent which teaches a belt with improved ratchet type buckling means. The ratcheting mechanism was constructed by a toothed belt and a releasable pawl in the buckle. In Application US20150113770A1 filed on 2014 Mar. 18 Robin Lazore taught a ratchet belt system which comprised a belt with a notch strip which extends along a portion of the length of the belt. The notch strip is formed of a plurality of adjacent notches, each being configured to engage a ratcheting pawl in the buckle. In principle, the notch strip is very similar to the toothed belt. Another invention which teaches a similar structured ratchet mechanism is presented by Jong Lee in application filed on 2004 May 7. The structure of toothed belt and similarly a notch strip belt is quite expensive to manufacture and is susceptible to accelerated wear since the imprinted belt is made of soft material. Furthermore, the ratchet pawl applies a strong shear force which equals to the total fastening force just on one tooth of the toothed belt. This shear force plays a major role in the belt's accelerated wear. In addition, the toothed structure is configured to provide fastening stations only at discrete spaces along the belt. In contrast, our invention does not suffer from these drawbacks.

Another prevalent approach for belt ratcheting is based on a ratchet wheel which rotates while mechanically linked to a cylinder with rough surface which compresses and fastens the belt. Such are the invention of Set-Up Kitten et al. in patent application DE3344489A1 filed on 1983 Dec. 6. Also in U.S. Pat. No. 5,647,824A filed on 1995 Oct. 25, Levenson teaches a Weight lifter's belt incorporating strap fastened by a ratchet wheel. In US7100901B2 filed on 2001 Jun. 28 Gerhard Gleasner taught a Tension ratchet with a belt magazine also utilizing a ratchet wheel mechanism. Ratchet wheel mechanism is utilized in many other belt fastening inventions. In another approach, described in application Ser. No. 16/297,655 filed on Mar. 9, 2019 Jezekiel Ben-Arie taught a belt ratcheting device which employs an adaptive blocking mechanism which restricts belt motion backward by a turning gate which applies an increasing pressure force on the belt, which is proportional to the backward pulling force, when the turning gate is turned backward by the belt motion backward. The adaptive blocking mechanism facilitates belt motion forward by the turning gate which diminishes the pressure force on the belt when the turning gate is turned forward by the belt motion forward. However, as detailed in the following sections, the adaptive blocking mechanism of Ben Aries ratcheting device has different structure compared to the belt ratcheting device described in the current application.

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forward and narrows backward. The laces pass through that passage and can be fastened by pulling the laces forward which in turn pulls forward the gear wheel towards the wider part of the passage where the laces are free to move. When the pulling stops the laces pull the gear wheel backward, which narrows the passage and blocks the laces' backward motion. The laces can be released by pulling the gearwheel forward with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borzoi and in U.S. Pat. No. 8,141,273 by Streamer. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in open position with the other hand and then switching the buckle into locked position. This results in cumbersome and inefficient fastening.

In U.S. Pat. No. 6,729,000 Liu uses for lace tightening a teethed rotating bar. In U.S. Pat. No. 6,076,241 by Borle and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jeh-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammers lag et al. teaches Real based closure system. U.S. Pat. No. 8,332,994 to Lin teaches Shoelace with shoelace fastener. U.S. Pat. No. 8,141,273 to Streamer et al. describes Shoes with directional conditioning device for laces. U.S. Pat. No. 8,231,074 to Hu et al. describes Lace winding device for shoes. U.S. Pat. No. 8,230,560 to Lullabied teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

MOM U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammers lag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening de vice. U.S. Pat. No. 7,082,701 to Dalsgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached de vice. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Ossawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Coraopolis teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Hurtle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Smouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Horiatis teaches a Footwear fastening system. U.S. Pat. No. 5,097,573 to Gimenez teaches Fastening Device for Lace Up Shoes. U.S. Pat. No. 5,001,847 to Waters teaches a Lace Fastener. U.S. Pat. No. 5,477,593 to Lick teaches a Lace Device. U.S. Pat. No. 6,282,817 to Curet teaches an Apparatus and Method for Lacing.

U.S. Patent Applications

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/025068 to Streamer describes a Shoe with Directional Conditioning Device for lace or the like. In US 2007/0169380 to Borzoi teaches a Device for B Flexible Strands. In US 2006/0213085 to Azam teaches an Article for Footwear with Linkage Tightening Device. In US 2005/0005477 to Borzoi teaches a Lace B Device. In US 2003/0226284 to Grande teaches a Lacing System For Skates. In US 2002/0002781 to Burier teaches a Lace Tightening Device Having a Pocket for Storing a B Element.

On Feb. 17, 2020 Ben-Arie filed application Ser. No. 16/792,324 entitled "Belt Ratcheting Device III" (BRD-III), which was configured to achieve similar objectives to the objectives listed in next Section below. However, the BRD-III employed a blade which engaged the upper surface of the belt and caused scratch marks on the upper surface of the belt. Thus the main goal of the "Belt Ratcheting Device with Hidden Blade IV" (HB-IV) described below is to avoid such scratch marks.

On Dec. 25, 2020 Ben-Arie filed application Ser. No. 17/134,247 entitled "Hidden Blade Belt Ratcheting Device IV" (BRD-IV), which was configured to achieve similar objectives to the objectives listed in next Section below. The BRD-IV employed a blade which engaged the lower surface of the belt and did not cause scratch marks on the upper surface of the belt. However, BRD-IV employed a bulky ratchet mechanism which did not provide elegant appearance to the belt. The "Belt Ratcheting Device with Hidden Blade IV" (HB-IV) described below avoids almost all the disadvantages of BRD-III.

BRIEF SUMMARY OF THE INVENTION

The objective of the invention of the: "Belt Ratcheting Device with Hidden Blade IV" (HB-IV) is to achieve the following goals:

1. A major goal of the invention is to configure a Belt Ratcheting Device with Hidden Blade IV (HB-IV) that facilitates a linear and continuous ratcheting of belts. For this purpose, it is required to configure a ratcheting mechanism that does not employ discrete ratcheting mechanism and therefore enables to fasten a large variety of continuous belts. HB-IV utilizes a mechanism which does not use discrete ladders attached to the belts and operates on belts with smooth surfaces. HB-IV engages only smooth lower surfaces of belts in order to avoid visible scratch marks on the belts' upper surfaces. It is also desired that the configuration of the ratcheting mechanism will be based on a novel ratcheting mechanism which provides linear, continuous and smooth ratcheting. The HB-IV utilizes a continuous ratcheting method which is entirely different from traditional discrete ratcheting methods which employ a pawl on a flexible ladder attached to the belt or a pattern belt imprinting such as notch strips or toothed surfaces. Our novel ratcheting mechanism employs a turning gate with a hidden blade front which is installed diagonally in the channel that carries through a portion of the belt. HB-IV has an active state and inactive state. In its active state HB-IV allows only unidirectional belt translation i.e. allows forward belt translation but prevents backward belt translation. The HB-IV does not need belt imprinting and enables fastening of a large variety of smooth surface belts made not just of leather but also of doth, plastics, or other elastic materials.

2. A second target of the invention is to develop a HB-IV with a mechanism that achieves a continuous and accurate level of fastening. It means that the user has just to pull the belt to the desired level of fastening and the belt remains fastened exactly at the desired fastening location after the pulling ceases. In contrast to HB-IV, other ratchet belts currently in the market provide only a limited range of discrete fastening. It means that a typical discrete ratcheting mechanism employs a ladder with limited range which enables the mechanism to stop only at a set of discrete locations. In addition, the discrete ratcheting mechanism's ladder has a limited length and allows ratcheting only within that limited ladder. In contrast, the HB-IV enables continuous ratcheting which is active along the full length of the belt. The HB-IV employs a slip less, continuous ratcheting mechanism, which strongly restricts belt motion backwards (i.e. untightening) but facilitates forward motion of the belt (i.e. tightening). The HB IV is configured to have a turning gate which restricts backward belt motion and applies on the belt a blocking force which is proportional to the backwards pulling force applied on the belt. The belt's backward direction (i.e. untightening direction) is defined as the direction of the belt translation from the channel's exit towards the channel's entrance.
3. A third objective of the invention is to design a HB-IV with a linear ratcheting mechanism which is mechanically more reliable because it has a simple structure which employs a minimal number of moving parts and therefore minimizes malfunction probability.
4. A fourth goal of the invention is to design a HB-IV with a linear ratcheting mechanism which causes minimal belt wear at the lower surface of the belt and does not engage the upper surface of the belt. Thus the hidden blade of the HB IV is configured to engage only the lower surface of the belt and to have also a smooth side which facilitates smooth belt sliding with minimal wear. In addition, the channel's gripping wall also is configured to have a smooth surface which facilitates smooth belt sliding with minimal wear.
5. A fifth target of the invention is to design a ratcheting mechanism with quick and easy manual activation of tightening and releasing. Thus the HB IV is configured to facilitate switching from active fastening state to inactive state (releasing state) simply by pulling a lever which activates or deactivates the ratcheting mechanism.
6. A sixth objective of the invention is to design for HB-IV a ratcheting mechanism structure which is suited for low-cost manufacturing and assembly. Such a mechanism should have a simple structure which employs minimal number of moving parts. Furthermore, to facilitate low-cost manufacturing, the HB IV is designed to be manufactured from plastic materials in its entirety except for a metallic blade. For low-cost production and economic manufacturing and assembly the HB-IV mechanism also employs plastic axles and bearings.
7. A seventh objective of the invention is to design a compact HB-IV ratcheting mechanism which is suitable also for fastening belts of footwear, garments, brassieres, watches, or other objects which employ belts.

This specification describes an embodiment of the invention which is a belt ratcheting mechanism. This mechanism is configured for ratcheting a large variety of smooth and elastic belts made of different materials with different thicknesses and widths. The Belt Ratcheting Device with Hidden Blade IV (HB-IV) is configured to have a compact size and thus it can be used to fasten belts, bands, straps, ribbons, waist belts, suspenders, sandals, brassieres, watch bands, garment belts etc. The HB-IV embodiment includes a linear ratcheting mechanism with two states: "active" and "inactive". In the inactive state the ratcheting mechanism is disabled and the belt is free to move forward and backward. In the active state the HB-IV mechanism works as a linear belt ratchet i.e. allowing the belt to be pulled forward but severely restricts or even completely blocks any belt motion backward. After the user has fastened the belt it remains fastened until the mechanism is switched into the inactive state. The HB IV ratcheting mechanism can be regarded also as an adaptive blocking mechanism which applies on the belt a blocking force which is proportional to the backwards tightening force applied on the belt. This adaptive blocking mechanism restricts backward belt motion very efficiently because it generates a pressure force which results in a friction-based belt blocking force which is proportional to the belt's backward pulling force. So, the hardest the belt is pulled backwards the strongest is the blocking force generated by the ratcheting mechanism which prevents it from moving backward.

The ratcheting device HB-IV is configured for fastening the belt. The ratcheting device includes a channel, a turning gate, a blade and an operating part which controls the turning gate. The channel is configured to carry through a portion of the belt. The channel further comprises a gripping wall being adapted with a gripping surface configured to engage the belt.

The ratcheting device has an active state and an inactive state. While in the active state, the ratcheting device is configured to restrict translation of the belt in the channel in the backward direction and to facilitate translation of the belt in the channel in the forward direction. While in the inactive state, the ratcheting device is configured to facilitate translation of the belt both in the forward direction and in the backward direction.

The turning gate is rotationally engaged with the channel and turns around an axis which serves as a fulcrum. The turning gate comprises an axle centered at the axis. The axle is merged with a bar except for a left axle end which protrudes from a left bar's end and a right axle end which protrudes from a right bar's end. The turning gate comprises a blade holder which is attached to the bar.

The ratcheting device comprises of a blade and the blade includes a blade front.

The blade is installed into the blade holder such that the blade front protrudes in front of the blade holder.

The turning gate is installed in the channel such that a straight line emanating from the blade front and passing through the fulcrum is at an obtuse angle with respect to the forward direction. The blade front is disposed within the channel opposite the gripping wall such that there is a gap between the blade front and the gripping wall. The belt is configured to pass through the gap.

The gripping surface of the gripping wall is facing downwards, and the blade front engages a lower surface of the belt by moving upwards.

The turning gate is configured to reduce the gap and to increase a pressure force exerted by the blade front on the belt when the turning gate is turned increasingly backward. The turning gate is configured to increase the gap and to reduce the pressure force exerted by the blade front on the belt when the turning gate is turned increasingly forward.

At the active state, the blade front is configured to exert the pressure force on the belt and the blade front is configured to frictionally engage the belt and to turn the turning gate forward when the belt is translated in the forward direction.

At the active state the blade front is configured to frictionally engage the belt and to turn the turning gate backward when the belt is translated in the backward direction.

At the active state the turning gate is configured to facilitate forward translation of the belt by turning increasingly forward and diminishing the pressure force of the blade front on the belt.

However, at the active state the turning gate is configured to restrict backward translation of the belt by turning increasingly backward and increasing the pressure force of the blade front on the belt.

At the inactive state of the ratcheting device, the blade front is configured not to exert the pressure force on the belt and translation of the belt is facilitated both in the forward direction and in the backward direction.

The ratcheting mechanism includes an operating part which has a structure which has a limited linear distance between two linearly connected ends: the first segment and second segment. Where the first segment and the second segment are also connected by a spring. The first segment is flexibly connected to the lever and the second segment is rotably connected to a turning axle installed at the upper side of the turning gate.

wherein pulling at the first segment by the lever, is configured to pull also the second segment which is resiliently connected to the first segment by the spring. The second segment which is being pulled by the first segment is configured to pull at the turning axle which is installed at the upper side of the turning gate.

Pulling at the turning axle, is configured to turn backwards the turning gate while moving the ratcheting device towards the active state. Pushing the first segment by the lever is configured to push also the second segment which also pushes the turning axle which is configured to turn forwards the turning gate while moving the ratcheting device towards the inactive state.

Therefore, moving the lever into the active lever position is configured to pull the operating part along with the turning axle which also turns backwards the turning gate while switching the ratcheting device into the active state.

wherein moving the lever into the inactive lever position is configured to push the operating part as well as the turning axle which also turns forwards the turning gate while switching the ratcheting device into the inactive state.

The lever comprises of a lever pole, a lever bearing and a tying post.

The lever bearing is attached to the bottom end of the lever pole. The tying post is attached to a middle point of the lever pole and is connected to the first segment of the operating part. Where the spring is connected to the first rnd and the second segment.

The ratcheting device is housed in a housing box. The upper wall of the housing box serves as the gripping wall. Where the gripping surface is facing downwards. The channel is located below the gripping wall between the gripping surface and an upper surface of a middle plate which is installed at a middle height of the housing box. Wherein the upper surface of the middle plate serves as a channel's floor. A lever axle is attached to a lower surface of the middle plate. The lever bearing is installed on the lever axle. The lever pole is parallel to the middle plate and extends from the lever's bearing towards a left side wall of the box. A top end of the pole protrudes from an L-shaped slit in the left side wall. The L-shaped slit in the left side wall is configured to guide the location of the top end of the pole.

The lever is configured to be at the inactive lever position when the top end of the pole resides at an end of a long arm of the L-shaped slit. When the lever is at the inactive lever position, it is configured to un-extend the and to push the first segment. This pushing is configured to push the turning axle which results in turning forwards the turning gate into the inactive state of the ratcheting device. The lever is configured to be at the active lever position when the top end of the pole resides at an end of a short arm of the L-shaped slit. When the lever is at the active lever position, it is configured to pull at the spring which is configured to pull at the turning axle which also turns backwards the turning gate into the active state of the ratcheting device.

The lever comprises of a lever pole, a lever bearing and a first segment's tying post.

The lever bearing is attached to the bottom end of the lever pole. The first segment's tying post is attached to a middle point of the lever pole and is flexibly connected to the first segment.

The ratcheting device is housed in a housing box. A top wall of the housing box serves as the gripping wall. The gripping surface is facing downwards and the channel is located below the gripping wall between the gripping surface and an upper surface of a middle plate which is installed at a middle height of the housing box. The upper surface of the middle plate serves as the channel's floor.

The lever axle is attached to the lower surface of the middle plate. The lever bearing is installed on the lever axle. The lever pole is parallel to the middle plate and extends from the lever's bearing towards the left side wall of the box. The top end of the pole protrudes from an L-shaped slit in the left side wall. The L-shaped slit in the right side wall is configured to guide the location of the top end of the pole.

The lever is configured to be at the inactive lever position when the top end of the pole resides at an end of the long arm of the L-shaped slit. When the lever is at the inactive lever position, it is configured to push the turning axle which is configured to facilitate turning forward the turning gate into the inactive state of the ratcheting device.

The lever is configured to be at the active lever position when the top end of the pole resides at an end of a short arm of the L-shaped slit. When the lever is at the active lever position, it is configured to pull the first segment and to extend the spring which is configured to pull the turning axle which also turns backwards the turning gate into the active state of the ratcheting device.

The blade is made of metal. The entire ratcheting device except the blade can be manufactured from plastics materials.

The turning gate comprises of the left axle end which is fitted into a left axle bearing drilled at a left side wall of the housing box and the right axle end is fitted into a right axle bearing drilled at a right side wall of the housing box.

DETAILED DESCRIPTION OF THE DRAWINGS

Figure 1:
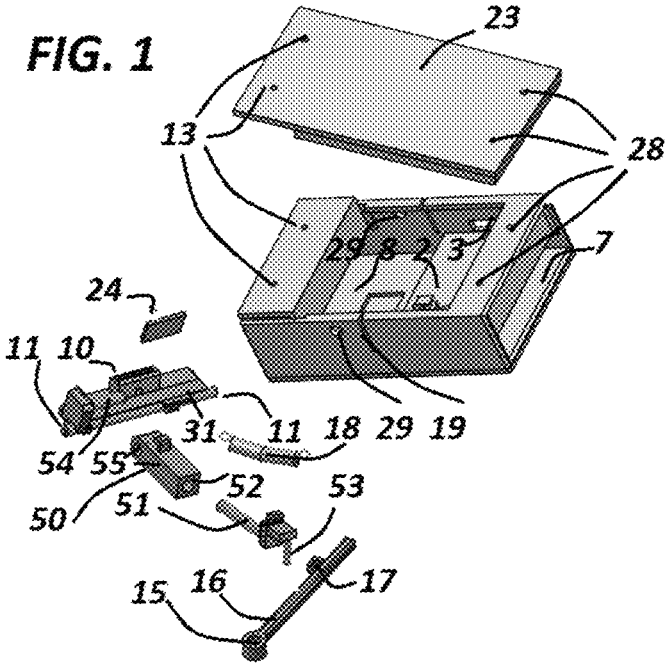
FIG. 1 illustrates in an isometric drawing a top view of the unassembled mechanical parts and the housing box of HB-IV.

FIG. 1 illustrates in an isometric drawing of a top view of the unassembled mechanical parts of HB-IV. A top view of the housing box 1 is shown in a position that allows better viewing of the inner structural details due to the large top opening of the housing box 1. Shown are all the HB-IV parts, which include the spring 18, the lever 16, the turning Gate 31 with its top attached turning axle 54 and the two turning gate's end axles 11 and its blade holder 10. Shown also the Blade 24 and the first segment 51 and the second segment 50. The first segment 51 is linearly connected to the second segment by a cylindrical pole 51 which fits into a cavity 52 in the second segment 50. The lever 16 is shown with its bearing 15 and its tying post 17. The cover 23 is depicted above the housing box 1.

The middle plate 2 which is parallel to the gripping wall 7 is installed at about the middle height of the housing box 1 and serves as the floor of the belt channel 8. The screw holes 13 are also marked. The cover's screw apertures 13 are used to screw the belt's second segment 22 to the housing box 1. The L slit 3 which guides the lever 16 is shown on the left side wall 26 of the housing box 1. The lever's post 5 which is attached to the middle plate 2 which serves as the floor of the channel 8 is also shown. The post 5 is the axle for the lever's bearing 15. The lever axle 5 is also attached to the middle plate 2. The gripping wall 7 which is installed at the top wall of the ratcheting device 1 is shown at the bottom of the housing box 1 because FIG. 1 presents a bottom view. The gripping wall 7 has a depression 30 which has been carved in order to increase the blocking force of the turning gate 31. Channel 8 is depicted on top of the gripping wall 7. The turning gate 31 has a bar 31 which is merged with the turning gate's axle 11. The tips of the axle 11 are protruding from the bar's ends and are installed in a pair of bearings 29 which are drilled at the housing box's side walls 26. The blade holder 10 is also attached in front of the bar 31. The spring 18 is configured to be connected between the first segment 51 and the second segment 50. The lever 16 has a bearing 15 which is installed on the bearing axle 5. The apertures 13 are used to hold two of the screws 24 which are designed to attach to the housing box 1 the belt's end 22 and the cover 23. Holes 28 are designed to hold two of the screws 24 which attach the cover 23 to the housing box 1. The pair of slits 19 in the side walls 26 are introduced to facilitate wall bending during installation of axle 11 into the bearings 29.

Figure 2:
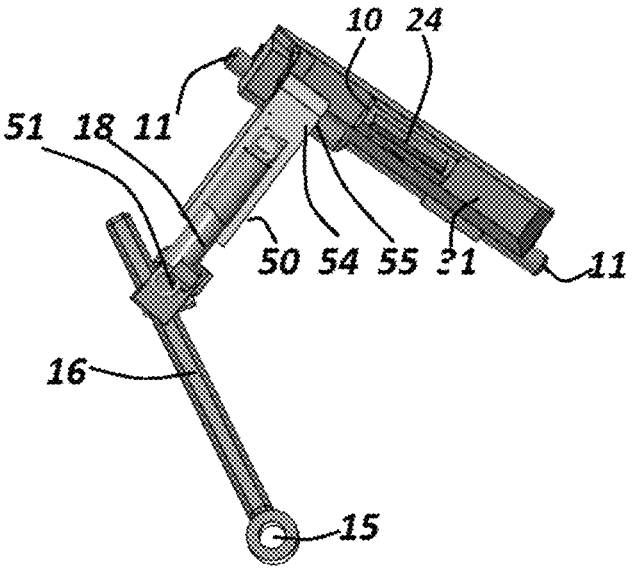
FIG. 2 illustrates in an isometric drawing a top view of the assembled mechanical parts of HB-IV to illustrate their assembly.

FIG. 2 illustrates in an isometric drawing a top view of the assembled mechanical parts of HB-IV to illustrate their assembly and function.

The turning gate 31 is shown with its two end axles 11, its blade holder 10 loaded with the blade 24. The turning axle 54 is installed in the bearing 55 of the second segment 50. The second segment 50 has also a cavity 52 which is mounted on top of the first segment 51. The spring 18 connects resiliently the first segment 51 with the second segment 50. By this manner the spring 18 transfers pulling forces created by the lever 16 and applied on the first segment 51 pulling the second segment 50. These pulling forces pull the turning axle 54 and the turning gate 31 backwards driving them into the active state. The pulling forces are created by lever 16 when it is turned into the active state region.

As also shown in FIG. 2 the first segment and second segment pair have a minimal linear dimension. Thus, when the first segment 51 is pushed by the lever 16 while turning on its bearing 15 and entering the inactive lever position, the pushing forces push the first end 51 into the second segment 50 which in turn pushes the turning axle 54 and the turning gate 31 forwards into the inactive state.

Figure 3:
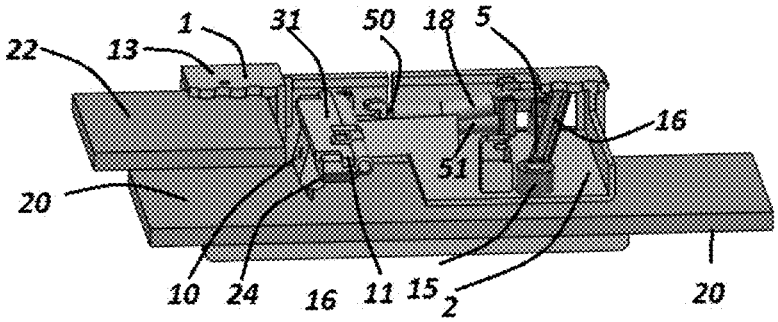
FIG. 3 describes a cross-sectional side view of an assembled ratcheting device HB-IV in an active state. The second belt end and parts of the housing box were removed because they obstruct inner structural details.

FIG. 3 describes a cross-sectional side view of an assembled ratcheting device 1 HB-IV in an active state in which, as shown, the blade 24 is squeezing against the belt 20. The lever 16 is pulled all the way rightwards into the end of the short leg of the L shaped slit 3. The second belt end 22 is attached to the housing box 1. Parts of the housing box 1 were removed because they obstruct inner structural details. The lever bearing 15 is mounted on lever's axle 5 which is attached to the middle floor 2.

Figure 4:
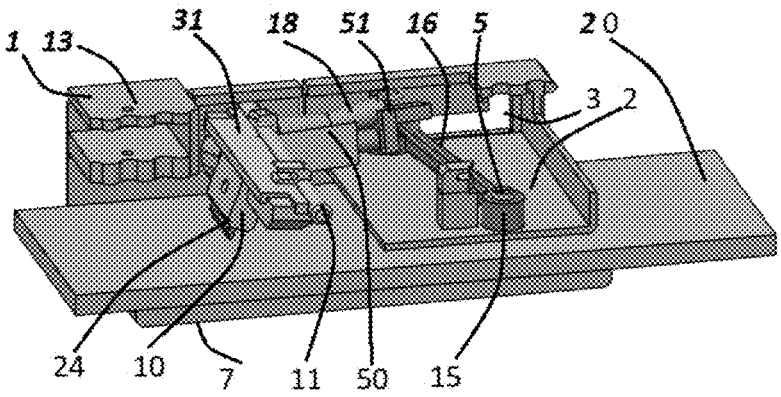
FIG. 4 depicts a cross-sectional side view of an assembled ratcheting device HB-IV in an inactive state. The second belt end and parts of the housing box were removed because they obstruct inner structural details.

FIG. 4 depicts a cross-sectional side view of an assembled ratcheting device 1 HB-IV in an inactive state. The second belt end and parts of the housing box were removed because they obstruct inner structural details.

FIG. 4 shows a side view of an assembled ratcheting device 1 HB IV in an inactive state in which, as shown, the blade 24 is not touching the belt 20. The lever 16 is pushed all the way leftwards into the end of the long leg of the L shaped slit 3.

The lever bearing 15 is mounted on lever's axle 5 which is attached to the middle floor 2.

Figure 5:
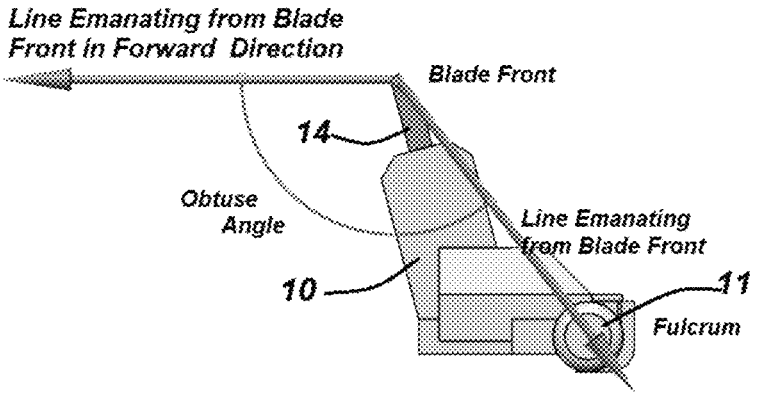
FIG. 5 describes the obtuse angular arrangement of the forward leaning diagonal arrangement of the turning gate and its attached blade front with respect to the fulcrum and the channel's forward direction.

FIG. 5 describes the obtuse angular arrangement of the forward leaning diagonal structure of the turning gate and its attached blade front 14 with respect to the fulcrum 11 and the channel's forward direction.

Figure 6:
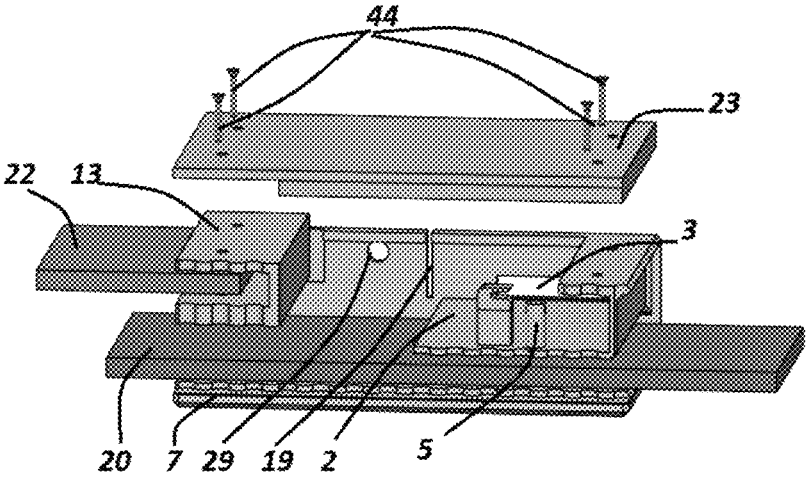
FIG. 6 depicts a cross-sectional side view of an assembled ratcheting device HB-IV. The view describes the tying arrangement of the belt's second segment and the box's cover.

FIG. 6 depicts a cross-sectional side view of an assembled ratcheting device HB-IV. The view describes the tying arrangement of the belt's second end 22 and the box's cover 23. Shown are the screws 44 which are used to tie the cover 23 and the belt's second segment 22 via apertures 13. The first belt's end 20 is also illustrated. In addition, the gripping wall 7, the turning gate bearing 29 and the mounting flexibility slot 19, the L slit 3 and the middle floor 2 are also shown.

What is claimed is:

1. A ratcheting device configured for fastening a belt;

wherein the ratcheting device comprising: a channel, a turning gate, a blade, a lever and an operating part;

wherein the channel is being configured to carry through a portion of the belt;

the channel further comprises a gripping wall being adapted with a gripping surface configured to engage the belt;

the ratcheting device has an active state and an inactive state;

while in the active state, the ratcheting device is configured to restrict translation of the belt in the channel in a backward direction and to facilitate translation of the belt in the channel in a forward direction;

while in the inactive state, the ratcheting device is configured to facilitate translation of the belt both in the forward direction and in the backward direction;

the turning gate being rotationally engaged with the channel and turns around an axis which serves as a fulcrum; wherein the turning gate comprises an axle centered at the axis; wherein the axle is merged with a bar except for a left axle end which protrudes from a left bar's end and a right axle end which protrudes from a right bar's end;

wherein the turning gate comprises a blade holder which is attached to the bar;

wherein the blade includes a blade front;

wherein the blade is installed into the blade holder such that the blade front protrudes in a front of the blade holder;

the turning gate is installed in the channel such that a straight line emanating from the blade front and passing through the fulcrum is at an obtuse angle with respect to the forward direction; wherein the blade front is disposed within the channel opposite the gripping wall such that there is a gap between the blade front and the gripping wall; wherein the belt is configured to pass through the gap;

the turning gate is configured to reduce the gap and to increase a pressure force exerted by the blade front on the belt when the turning gate is turned increasingly backward; wherein the turning gate is configured to increase the gap and to reduce the pressure force exerted by the blade front on the belt when the turning gate is turned increasingly forward;

at the active state, the blade front is configured to exert the pressure force on the belt and the blade front is configured to frictionally engage the belt and to turn the turning gate forward when the belt is translated in the forward direction;

wherein at the active state the blade front is configured to frictionally engage the belt and to turn the turning gate backward when the belt is translated in the backward direction;

wherein at the active state the turning gate is configured to facilitate forward translation of the belt by turning increasingly forward while diminishing the pressure force of the blade front on the belt;

wherein at the active state the turning gate is configured to restrict backward translation of the belt by turning increasingly backward while increasing the pressure force of the blade front on the belt;

at the inactive state of the ratcheting device, the blade front is configured not to apply the pressure force on the belt and translation of the belt is facilitated both in the forward direction and in the backward direction;

wherein the lever is flexibly connected to the turning gate via the operating part; wherein the lever is configured to switch the ratcheting device into the active state when the turning gate has been pulled by the lever and has been turned backward when the lever has been moved into an active lever position;

wherein the lever is configured to switch the ratcheting device into the inactive state when the turning gate has been pushed by the lever and has been turned forward when the lever has been moved into an inactive lever position.

2. The ratcheting device of claim 1, wherein the operating part includes a first segment, a second segment and a spring;

wherein the first segment has a linear sliding connection with the second segment; wherein the linear sliding connection facilitates linear sliding only within a range of minimal and maximal lengths;

wherein the first segment is also resiliently connected to the second segment by the spring; wherein the operating part has a structure which is configured to conduct a pushing force or a pulling force;

wherein the second segment is rotationally connected to a turning axle attached at an upper side of the turning gate; wherein the first segment is flexibly connected to the lever;

wherein pulling at the first segment by the lever, is configured to pull also the resiliently connected second segment; wherein the second segment which is being pulled by the first segment is configured to pull at the turning axle;

pulling at the turning axle, is configured to turn backwards the turning gate while moving the ratcheting device towards the active state;

wherein pushing the first segment by the lever is configured to push also the second segment which pushes the turning axle which is configured to turn forwards the turning gate while moving the ratcheting device towards the inactive state;

wherein moving the lever into the active lever position is configured to pull the turning axle which turns backwards the turning gate while switching the ratcheting device into the active state;

wherein moving the lever into the inactive lever position is configured to push the turning axle which turns forwards the turning gate while switching the ratcheting device into the inactive state.

3. The ratcheting device of claim 2, wherein the lever comprises of a lever pole, a lever bearing and a tying post;

wherein the lever bearing is attached to a bottom end of the lever pole; the tying post is attached to a middle point of the lever pole and is flexibly connected to the first segment;

wherein the ratcheting device is housed in a housing box; a top wall of the housing box is the gripping wall; wherein the gripping surface is facing downwards; the channel is located below the gripping wall between the gripping surface and an upper surface of a middle plate which is installed at a middle height of the housing box; wherein the upper surface of the middle plate serves as a channel's floor;

a lever axle is attached to a lower surface of the middle plate;

the lever bearing is installed on the lever axle; the lever pole is parallel to the middle plate and extends from the lever's bearing towards a left side wall of the box; a top end of the pole protrudes from an L-shaped slit in the left side wall; wherein the L-shaped slit in the left side wall is configured to guide the location of the top end of the pole;

wherein the lever is configured to be at the inactive lever position when the top end of the pole resides at an end of a long arm of the L-shaped slit;

wherein when the lever is at the inactive lever position, it is configured to push the first segment which pushes the second segment; the second segment then pushes the turning axle, which is configured to turns forward the turning gate into the inactive state of the ratcheting device;

wherein the lever is configured to be at the active lever position when the top end of the pole resides at an end of a short arm of the L-shaped slit;

wherein when the lever is at the active lever position, it is configured to pull the first segment and to extend the spring which is configured to pull the second segment, which pulls the turning axle which also turns backwards the turning gate into the active state of the ratcheting device.

4. The ratcheting device of claim 1, wherein the blade is tapered and sharpened at the blade front; wherein the sharp blade front is adapted with a smooth side;

wherein, the sharp blade front is configured to concentrate the pressure force on the belt when the turning gate is turned backward while the sharp blade front engages the belt;

wherein, the smooth side is configured to engage the belt when the turning gate is turned forward;

wherein, the smooth side is configured to facilitate the belt sliding while the turning gate is turned forward and the belt is translated.

5. The ratcheting device of claim 1, wherein the gripping surface of the gripping wall is adapted with a smooth gripping surface;

wherein, the smooth gripping surface is configured to facilitate the belt sliding when the belt is fastened at the active state and also when the belt is translated in the inactive state;

wherein the gripping surface of the gripping wall is facing downwards, and the blade front engages a lower surface of the belt by moving upwards.

6. The ratcheting device of claim 1, wherein the ratcheting device further comprising a depression disposed on the gripping surface of the gripping wall; wherein the depression is configured to facilitate an additional bending of the belt due to the pressure force;

wherein, the additional bending is configured to increase a mutual friction force between the belt and the gripping surface of the gripping wall while the ratcheting device is in the active state and the belt is pulled in the backward direction.

7. The ratcheting device of claim 1, wherein the belt further comprises a first belt end and a second belt end; wherein the ratcheting device is configured for fastening the belt by tying the second belt end to the ratcheting device and fastening the first belt end with the ratcheting device; wherein, the second belt end is tied to the ratcheting device using screws or rivets; wherein, when the belt is fastened, the first belt end is configured to pull the ratcheting device in the backward direction, while the second belt end is configured to pull the ratcheting device in the forward direction.

8. The ratcheting device of claim 1, wherein at least one ratcheting device which is anchored to a footwear item, is configured to fasten the belt which is attached to the footwear item.

9. The ratcheting device of claim 1, wherein the blade is made of metal.

10. The ratcheting device of claim 1, wherein the entire ratcheting device except the blade is made of plastics materials.

11. The ratcheting device of claim 1, wherein the turning gate comprises of the left axle end which is fitted into a left axle bearing drilled at a left side wall of the housing box and the right axle end which is fitted into a right axle bearing drilled at a right side wall of the housing box.

* * * * *